US006014685A

United States Patent [19]

Marshall et al.

[11] Patent Number: 6,014,685

[45] Date of Patent: Jan. 11, 2000

[54] ELECTRONIC CIRCUIT FOR DETERMINATION OF DISTANCES BETWEEN REFERENCE AND DATA POINTS

[75] Inventors: Gillian Fiona Marshall; Stephen Collins, both of Malvern, United Kingdom

[73] Assignee: The Secretary of State for Defence in Her Britannic Majesty's Government of the United Kingdom of Great Britain and Northern Ireland, Farnborough, United Kingdom

[21] Appl. No.: 08/737,373

[22] PCT Filed: Mar. 31, 1995

[86] PCT No.: PCT/GB95/00741

§ 371 Date: Nov. 12, 1996

§ 102(e) Date: Nov. 12, 1996

[87] PCT Pub. No.: WO95/30963

PCT Pub. Date: Nov. 16, 1995

[30] Foreign Application Priority Data

May 5, 1994 [GB] United Kingdom ..... 9408894

[51] Int. Cl.[7] ..... G06G 7/00

[52] U.S. Cl. ..... 708/801

[58] Field of Search ..... 364/807; 326/37, 326/38, 44; 395/24; 708/801

[56] References Cited

U.S. PATENT DOCUMENTS 3,864,558 2/1975 Yu .

4,999,525 3/1991 Park et al. .

5,336,937 8/1994 Sridhar et al. ..... 395/24

FOREIGN PATENT DOCUMENTS 2267172 11/1993 United Kingdom .

OTHER PUBLICATIONS

Electronics Letters, vol. 28, No. 4, FEb. 13, 1992, pp. 352–354, XP 000292285, Landolt O et al, "CMOS Selfbiased Euclidean Distance Computing circuit with high dynamic range".

*Primary Examiner*—Tan V. Mai

*Attorney, Agent, or Firm*—Nixon & Vanderhye P.C.

[57] ABSTRACT

An electronic circuit for Euclidean distance determination includes two floating gate transistors (M1, M2) connected in parallel. Voltages representing a reference point and its complement are applied to input lines (22, 24) and corresponding charges become stored on the transistors' floating gates (F1, F2). Voltages representing a data point and its complement are input to control gates (G1, G2). The transistors (M1, M2) produce a combined output current which is a quadratic or exponential function of the distance between the data and reference points according to whether the transistors are above or below threshold. The circuit (10) includes a diode-connected load device (M3) for deriving the square root of the output current, which is proportional to Euclidean distance when the transistors are operated above threshold. Refresh means (M44, M45) may be provided for resetting reference points. An array of circuits of the invention is employed for determination of distances between vector quantities.

41 Claims, 5 Drawing Sheets

ELECTRONIC CIRCUIT FOR DETERMINATION OF DISTANCES BETWEEN REFERENCE AND DATA POINTS

BACKGROUND OF THE INVENTION

1. Field of the Invention

This invention relates to an electronic circuit. More particularly, although not exclusively, it relates to an electronic circuit for determination of distances between reference and data points.

2. Discussion of Prior Art

Electronic circuits for determining Euclidean distances are known in the prior art. Such a circuit incorporates a stored quantity corresponding to a reference point and accepts as input a signal representing a data point. It produces a measure of the distance between the input signal and the stored quantity. Such circuits are useful in applications in which calculations of Euclidean distance would consume a substantial amount of computing capacity. In visual and speech recognition, together with other forms of pattern recognition, it is necessary to determine Euclidean distance between large numbers of input data points and each point in a large database of reference points.

U.S. Pat. No. 3,864,558 discloses a pair of field effect transistors (FETs) with programmable memories arranged to determine the square of the distance between two points represented by voltages. The FET memories are programmed by setting the threshold voltage. When the transistors are operated in saturation, the output current is dependent on the square of the difference between this programmed voltage and an applied gate voltage and hence is representative of the distance required. A p-channel and an n-channel FET are connected source to drain in antiparallel. The two gates are connected together such that only one FET conducts under an applied gate bias, the particular FET producing the distance representation being dependent on whether the applied gate voltage is greater or less than the stored threshold voltage. In this way an analogue for the square of the difference between a first magnitude and a second magnitude is produced regardless of the polarity of this difference. Using dissimilar-type FETs however makes it difficult to match device characteristics. Differing carrier mobilities and other physical characteristics mean that extreme difficulty is met in making allowance for the effects of device mismatch.

In "A Neural Network Capable of Forming Associations by Example", Neural Networks Vol. 2 pages 395–403, 1989, Hartstein and Koch disclose a similar arrangement of FETs. A two-transistor circuit is used in a neural network to represent the difference between a voltage input and a stored or learned value. Two metal oxide semiconductor field effect transistors (MOSFETs), a p-channel and an n-channel MOSFET are this time connected in parallel in a symmetric arrangement in order to obtain a symmetric output function for the neural network. Hartstein and Koch are not however concerned with Euclidean distance determination, but instead output function symmetry. This symmetry requires close matching of the characteristics of the p-channel and n-channel devices and if it is not achieved, the output of the circuit is not suitable for Euclidean distance determination.

In "Programmable Analogue VLSI for Radial Basis Function Networks", Electronics Letters 29(18), pages 1663–1665, September 1993, Churcher et al. describe a transconductance amplifier which produces an output current proportional to the square of the difference (distance) between an input voltage and a stored voltage maintained by a capacitor. The amplifier produces an approximation to the square of the Euclidean distance between the input and stored voltages. It is not suitable for applications such as pattern recognition requiring a large number of distance measuring circuits. It incorporates a number of transistors, two of which are considerably wider than the rest, which gives rise to difficulty as regards formation of large arrays. The transistors also suffer from high power consumption when operating in their saturation region.

A similar disadvantage is apparent in the circuit described in "CMOS Selfbiased Euclidean Distance Computing Circuit with High Dynamic Range", Electronics Letters 28 (4) page 352, 1992. O. Landolt, E. Vittoz and P. Heim describe a device which outputs a representation of the function $$I_{out} = \sqrt{\sum_{i=1}^{n} I_i^2}$$

for the n-dimensional vector of bi-directional currents $I_1, \ldots I_n$. However, to calculate Euclidean distance, these currents cannot be representative of vector components in themselves but of the difference between vector components. Such currents can be generated using a simple switched-current memory cell, but this will require a minimum of four extra transistors per dimension. Thus the complete circuit containing both the square-law distance calculation and the current memories is not sufficiently compact for practicable incorporation into large arrays.

A two-transistor cell has been designed by Castro and Park (U.S. Pat. No. 4,999,525). It employs two floating gate transistors to implement an exclusive-or operation between two digital patterns. Cells are cascaded together to calculate a Hamming distance between an input vector and a stored reference vector. The cell requires a separate high-gain inverter to complement the input vector, restricting the cell to digital operation.

In "An Analog VLSI Chip for Radial Basis Functions", Advances in Neural Information Processing Systems 5, Morgan Kaufmann 1933, Anderson et al. disclose a distance determination chip employing an inverter with an adjustable threshold. The threshold is set using a floating gate device such as that described by S. M. Sze in "Physics of Semiconductor Devices", Wiley 2nd Edition 1981, page 496. This device is programmed using a combination of non-avalanche injection and tunnelling.

The Anderson et al. circuit has a major disadvantage that its output does not correspond to a true Euclidean distance or square of a Euclidean distance. Instead, the output current approximates to a quadratic function only in the region of a peak current value. The approximation is only valid over a short range of input voltages, less than 0.35V in the implementation of Anderson et al.

A low-power difference calculating neural network developed by M. A. Holler, S. M. Tam and A. H. Kramer is described in UK Patent Application 2 267 172. This network calculates the absolute "City Block Distance" between an input voltage and a stored reference point, referred to as a weight. The weight is stored by means of a floating gate charge which determines the threshold voltage of the device. An applied input (data) voltage causes charges to develop within the channel regions of selected MOSFETs, the magnitude of this charge being proportional to the difference between the applied data voltage and the threshold voltage.

The MOSFETs of the same column are then discharged and the associated charge packets of a column of MOSFETs are summed. This summed charge thus represents the City Block distance for that column.

The City Block calculation does not have as many or as useful applications as the Euclidean distance calculation. City Block, also known as Manhattan, distances are sensitive to a change of axes and so assumptions have to be made regarding the nature of the data in order that appropriate axes are selected. Euclidean distance is far more useful in practical applications because its inherent symmetry renders it independent of axes orientation. It thus offers a more robust and portable technique for distance calculation. Further disadvantages arise from operating in the charge domain in preference to the current domain. The accuracy with which charge is stored on floating gate devices is generally an indeterminable quantity; the reference level may therefore carry an inherent uncertainty. Moreover, even identically produced MOSFETs exhibit inter-device variations leading to differing threshold voltages.

Each of the foregoing prior art techniques suffers from at least one of the following disadvantages: unadapted to Euclidean distance calculation, large chip area requirements, high power consumption and restriction to a short range of input voltages or to digital implementation only. There is a perceived need for a circuit which admits of compact construction, is operative over a useful range of input voltages, calculates the more useful Euclidean distance and is suitable for analogue implementation. There is also a trend towards developing lower-power devices suitable for distance calculations in portable systems.

SUMMARY OF THE INVENTION

It is an object of the invention to provide an alternative form of electronic circuit suitable for use in distance determination such as the Euclidean norm.

The present invention provides an electronic circuit comprising (i) a programmable threshold transistor pair of like channel conductivity type associated with a common output, and (ii) means for applying complementary analogue input voltages to the transistor pair characterised in that the circuit also includes programming means for programming the threshold voltages of the transistor pair to provide for output current to be a quadratic or exponential function of the difference between a programmed reference and subsequent transistor pair input data voltages in complementary analogue form.

The invention has the advantage that it provides a measure of distance between data and reference points represented as input and reference voltages, and it is capable of construction in compact form with low power requirements. It is well suited to replication to form an array of circuits for performing multiple and multidimensional distance determinations.

The transistor pair of the invention may be arranged for sub-threshold operation. The programming means may include means for applying programming voltages to the transistor pair such that the supply of the reference voltage, in conjunction with the supply of the programming voltages, and the subsequent supply of the input data voltage causes a signal at the common output which is an exponential function of the difference between the reference and data voltages.

This embodiment of the invention is advantageous because of its suitability for low voltage applications.

The input voltages may be in the range 0V to 3.3V, or, preferably 0V to 1.5V, thereby rendering the circuit capable of operation with a conventional digital logic power supply of 3.3V or a 1.5V battery power supply respectively.

The circuit of the invention preferably includes a diode-connected load transistor having a drain connected to the common output and arranged to produce an output voltage which is a function of the difference between the reference voltage and the input data voltage. The load transistor may also be arranged for sub-threshold operation. This feature is capable of further limiting power consumption.

The circuit of the invention may be incorporated into an array of like electronic circuits each having a respective transistor pair, at least some of the transistor pairs having outputs connected to a common summing means and thereafter to a diode-connected load transistor arranged for sub-threshold operation such that the load transistor output voltage is substantially proportional to the natural logarithm of the sum of the output currents from the selected transistor pairs. Such an array provides the capability for performing multiple and multidimensional distance determinations.

In another aspect, the invention provides an electronic circuit characterised in that the programming means includes means for applying programming voltages of sufficient magnitude to operate the transistor pair in their saturation regions and to provide for them to exhibit an output current proportional to a quadratic function of the difference between a reference voltage and an input data voltage. In this aspect, the invention provides a measure of the square of the Euclidean distance between a reference point and a data point represented by circuit voltages.

The invention preferably also includes means for applying respective input voltages to the transistor pair simultaneously, one input voltage being the complement of the other. This pair formation enables the circuit to give a Euclidean distance output regardless of whether the reference voltage is lower or higher than the data voltage.

The programmable transistor pair may be metal oxide field effect transistors each of the kind incorporating a control gate and a floating gate and further characterised in that the programming means comprises a means for storing charge on the floating gates.

The circuit preferably includes means for deriving square roots connected to the common output, which in a preferred embodiment is a diode-connected load transistor having a drain connected to the common output and arranged to produce an output voltage substantially proportional to the difference between the reference and data voltages. This lends itself to incorporation into an array of like electronic circuits each having a respective transistor pair, at least some of the transistor pairs having outputs connected to a common summing means and thereafter to a diode-connected load transistor such that the load transistor output voltage is substantially proportional to the square root of the sum of the output currents from the selected transistor pairs. This enables the Euclidean distance between multicomponent data and reference vectors to be output as a representative voltage at the load transistor.

In a further aspect, the invention may also include resetting means for periodically resetting the programmable transistor pair for the purposes of reprogramming with a different value of reference voltage. In one embodiment, the resetting means may include respective conducting means connected to the floating gates and activatable to conduct when exposed to ultra-violet light, ultra-violet window means arranged over the conducting means, and means for illuminating the conducting means with ultra-violet radiation. This resetting technique is useful for instances in which the reference voltages rarely change, and for initialisation to remove unwanted charge from the circuit. In a second embodiment, the resetting means may include first and second reset transistors arranged to supply programming voltages to the floating gates. The reset transistors may be controllable by a reset voltage to provide for:

(i) application of programming voltages to the floating gates, and (ii) isolation of the floating gates.

This resetting technique is advantageous to applications in which the positions of reference points are required to be changed electronically. It also provides a means of programming the reference voltages with greater accuracy and repeatability.

In a further aspect of the invention, each transistor of the transistor pair has a current output connected to respective switching means, the switching means is connected to threshold programming means and to current summing, and the switching means is operative to switch the transistor output current from the threshold programming means to the current summing means in response to a predetermined circuit condition. This provides the capability of setting the reference point representation stored in each transistor by reference to that transistor's output source-drain current prior to performing the circuit calculations. This provides for individual programming of each transistor to compensate for variation in device characteristics and enables the reference voltage to be programmed to a high degree of accuracy.

The circuit is preferentially arranged such that the transistor pair comprises floating gate transistors, and the switching means comprises a second transistor pair of unlike-channel transistors. An injecting means may also be arranged to apply a programming voltage of sufficient magnitude to establish charge injection onto the floating gates and thereby to enable variation of transistor current output. This feature provides a straightforward realisation of a mechanism for varying each transistor's output current for the purposes of programming as described above. The circuit may additionally be arranged such that the threshold programming means is connected to a data input line and arranged to switch a voltage applied to the data input line to a value of sufficient magnitude to prevent charge injection onto the floating gates in response to attainment of a predetermined current. This arrangement is capable of providing a mechanism by which drain-source current variation is halted when a desired value is reached. This value is accordingly representative of the reference point used in subsequent circuit calculations.

Each of the aforementioned electronic circuits may be incorporated into an array of like circuits. This provides for the determination of multiple and multidimensional distances.

An array of electronic circuits of the invention may be characterised in that each transistor of every transistor pair has a current output connected to switching means, the switching means is connected to threshold programming means and to current summing means, the switching means is operative to switch the transistor output current from the threshold programming means to the current summing means in response to attainment of a predetermined circuit condition and each circuit is connected to a pair of data input lines associated with a column of the array and to a threshold programming line and a switching activation line both associated with a row of the array. This feature provides the capability for each transistor in an array of circuits to be programmed individually to a desired level of source-drain current prior to the array performing a multidimensional calculation.

In an alternative aspect the invention may comprise an array of electronic circuits, each circuit incorporating a pair of programmable threshold transistors, characterised in that the array includes:

(i) a respective programming means for altering the threshold of each transistor to provide for individual programming of each transistor with a reference voltage, the programming means being responsive to output current of said transistor;

(ii) input means for applying input voltages to the transistors in each pair simultaneously, one of the input voltages to each transistor of a pair being the complement of the input voltage to the other transistor of that pair;

(iii) summing means for adding the output currents of the transistors;

(iv) a respective switching means connected to receive output current from each transistor and operative to switch the transistor output current from the programming means to the summing means in response to attainment of a predetermined circuit condition.

In this aspect the invention is capable of multidimensional distance calculation with a reference point which is capable of being accurately stored by virtue of an addressable feedback mechanism. Such an individual feedback mechanism renders the circuit capable of reducing the effect of inter-device variation in transistor characteristics.

This aspect of the invention may also include operating means for programming each transistor to operate either above or below threshold and to produce an output current which is a quadratic or exponential function of the difference between the reference voltage and an input data voltage. This provides the advantage of flexibility. The same circuit is adaptable to be used both in Euclidean distance determination and in its sub-threshold region.

The array may comprise electronic circuits connected to form rows and columns, the circuits in each column having inputs connected to a respective pair of data input lines, and each row incorporating a respective programming line connected to the programming means of circuits therein and a respective switching activation line connected to the switching means of circuits therein. It may also include an injecting means arranged to apply a voltage to the programming line of sufficient magnitude to establish charge injection onto the floating gates of all transistors in a row. The threshold programming means may be arranged to switch the voltage applied to the data input line to a value of sufficient magnitude to prevent charge injection onto the floating gates of all transistors in a column in response to attainment of a predetermined circuit condition. This enables individual programming of transistors. This provides the array with the advantage of increased operating flexibility. Each transistor of the array is individually addressable and programmable in this manner, prior to the array being arranged to perform a multidimensional distance calculation.

In an alternative aspect, the invention provides a method for determining a distance between two points represented by analogue voltages, and comprising the steps of:

(a) providing a circuit incorporating two programmable threshold voltage transistors associated with a common current output.

(b) arranging the transistors to provide for their output current to be a quadratic or exponential function of the difference between a programmed reference voltage and subsequent transistor input data voltages in complementary form, (c) programming the transistors with stored reference voltages, one such voltage being the complement of the other, (d) applying analogue input data voltagtes to the transistors, one such voltage being the complement of the other.

This method of the invention provides the advantage that it is suited to low-power implementations of both Euclidean distance calculations and sub-threshold applications requiring faster processing speeds than are achievable by computer. Additionally it is realisable both in individual circuit and array constructions.

Another aspect of the invention provides a method of reprogramming a circuit arranged for the calculation of a function of the difference between two voltages, the circuit comprising a pair of programmable transistors, each transistor incorporating a respective control gate and a respective floating gate characterised in that the method comprises the steps of:

(a) applying programming voltages to switching means connected to respective floating gates of the transistor pair, (b) applying a reset voltage to the switching means whereby the programming voltages are communicated to the floating gates, (c) applying a reference voltage in complementary analogue form to the control gates of the transistor pair, (d) removing the reset voltage from the switching means and thereby electrically isolating the floating gates, and (e) removing the reference voltage from the control gates.

BRIEF DESCRIPTION OF THE DRAWINGS

In order that the invention might be more fully understood an embodiment thereof will now be described with reference to the accompanying drawings in which.

DETAILED DISCUSSION OF PREFERRED EMBODIMENTS

Figure 1:
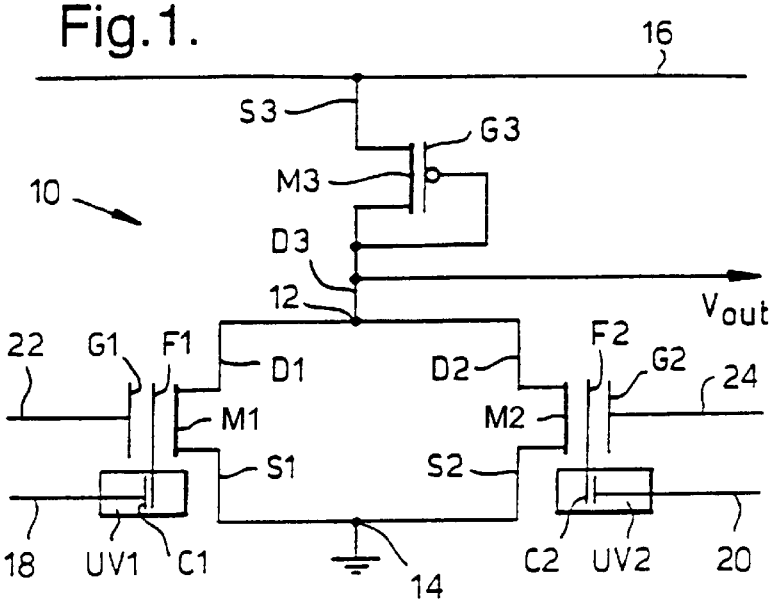
FIG. 1 is a schematic diagram of a circuit of the invention.

Referring to FIG. 1, there is shown an electronic circuit of the invention indicated generally by 10. The circuit 10 incorporates first and second metal-oxide semiconductor field effect transistors (MOSFETs) M1 and M2. The MOSFETs M1 and M2 are floating gate devices, generally as outlined by S M Sze in "Physics of Semiconductor Devices", 2nd Ed Wiley 1981, page 496. MOSFET M1 has a floating gate F1 and a control gate G1, and likewise MOSFET M2 has floating and control gates F2 and G2. In IEEE Electron Device Letters, Vol.12 No 3, March 1991, Thomsen and Brooke have estimated that a floating gate in a silicon MOSFET would lose charge at the rate of 0.1% in 26 years. Data represented by charge on the floating gates F1 and F2 is therefore expected to persist.

The MOSFETs M1 and M2 are parallel NMOS transistors which are used to determine the distance between a data point and a reference point. The data point is represented by input signals consisting of a voltage and its complement, these being applied to the control gates G1 and G2 respectively. The reference point is represented by charges stored on the floating gates F1 and F2. The MOSFETs M1 and M2 have respective drains D1 and D2 connected together at a common drain node 12. They also have respective sources S1 and S2 connected together and to earth at a common source node 14.

A third MOSFET M3, a conventional PMOS device, has a drain D3 connected to the common drain node 12 and to an control gate G3. It therefore constitutes a diode-connected load for both MOSFETs M1 and M2 connected in parallel. It has a source S3 connected to a power supply line 16 voltage $V_{DD}$ which is positive with respect to earth at the common source node 14. The floating gates F1 and F2 have coupling capacitors C1 and C2 connected to respective reference input lines 18 and 20. The lines 18 and 20 are arranged to provide a voltage $V_{match}$ to respective capacitors C1 and C2 and thence to floating gates F1 and F2.

The circuit 10 has a UV opaque coating (not shown) through which are formed ultra-violet (UV) transparent windows UV1 and UV2 loacted over floating gate/capacitor combinations F1/C1 and F2/C2 respectively. The windows UV1 and UV2 facilitates UV illumination of the floating gate F1 and capacitor C1 in combination and floating gate F2 and capacitor C2 in combination respectively. Data input lines 22 and 24 are connected to respective control gates G1 and G2. Data input line 22 is arranged to provide a voltage $V_{data}$ to control gate G1, and data input line 24 is arranged to provide a voltage equal to $(V_{DD}-V_{data})$ to control gate G2. $V_{data}$ corresponds to the voltage of a data point and $(V_{DD}-V_{data})$ to its complement. The value $V_{data}$ is in the range 0 to $V_{DD}$. The complement voltage may be generated by a conventional differential amplifier arranged to subtract $V_{data}$ from $V_{DD}$ with unity gain. A suitable amplifier is shown at page 99 of P. Horowitz and W. Hill, Cambridge University Press, 1980, ISBN 0521 23151 5.

The operation of the electronic circuit 10 will now be described in general terms, a theoretical analysis being given later. The objective is to determine the Euclidean distance d between a data point and a set reference point. The MOSFET floating gates F1 and F2 have the function of analogue memory devices to which electric charge is injected and stored. The stored charge corresponds to a predetermined reference point.

Charge is introduced on to the floating gates F1 and F2 by a UV-enabled conduction process. The circuit 10 is illuminated with UV radiation which passes through the windows UV1 and UV2 only. This renders the capacitors C1 and C2 conducting; ie they develop leakage current because of UV-activated conduction in their dielectric material. The voltages on the reference input lines 18 and 20 consequently become applied to the floating gates F1 and F2 via the now conducting capacitors C1 and C2 respectively. The process is described in more detail by D A Kerns et al. in "CMOS UV-Writable Non-Volative Analog Storage": "Advanced Research in VLSI: Proceedings of Santa Cruz Conference 1991, Santa Cruz Calif., Mar. 25–29, 1991", page 245. The MOSFETs M1 and M2 are programmed as follows. A voltage $V_{match}$ is applied to reference input lines 18 and 20. It is of sufficient magnitude to establish the channel surface potential of MOSFETs M1 and M2 at the "turn-on" voltage (threshold voltage $V_t$) at which strong inversion occurs. Strong inversion is defined by Sze (see reference above) at page 373. The exact value chosen for $V_{match}$ is not critical so long as it is a little above $V_t$ in the present embodiment of the invention. Simultaneously with application of $V_{match}$, a voltage $V_{ref}$ and is complement ($V_{DD}-V_{ref}$) are applied to the data input lines 22 and 24 respectively, and the circuit 10 is illuminated with UV radiation. This combination of applied voltages results in a charge corresponding to the position of a reference point y being stored on floating gates F1 and F2. The theoretical basis for this is described in detail later.

The UV illumination is now switched off, and the voltages $V_{match}$, $V_{ref}$ and ($V_{DD}-V_{ref}$) are removed from lines 18/20, 22 and 24 respectively.

The theoretical basis for the invention is as follows. Generally for an NMOS MOSFET with gate-source voltage $V_{gs}$ and threshold voltage $V_t'$ a conducting channel between source and drain is formed when $V_{gs}$ is greater than $V_t$. When the voltage between the source and drain, $V_{ds}$, is greater than ($V_{gs}-V_t$) the MOSFET operates in its saturation region, and its drain-source current $I_{ds}$ is substantially independent of $V_{ds}$.

For a MOSFET in saturation, the equation for the drain-source current $I_{ds}$ is as follows:

$$I_{ds} = \frac{\beta}{2}(V_{gs} - V_t)^2 \tag{1}$$

where β is a proportionality constant given by:

$$\beta = \frac{W}{L}\mu C_{ox} \tag{2}$$

In equation (2), L is the length of the condution channel between source and drain, W is the width of the conduction channel, $\mu$ is the charge carrier mobility and $C_{ox}$ is the capacitance of oxide between the MOSFET gate and associated conduction channel.

Ignoring constants, equation (1) has the same form as the equation for the Euclidean distance d between two points x and y:

$$d^2=(x-y)^2 \tag{3}$$

Comparison of equations (1) and (3) indicates that MOSFET drain-source current $I_{ds}$ provides a measure of the square of the Euclidean distance d between two points x and y represented by gate-source voltage $V_{gs}$ and threshold voltage $V_t$ respectively. However, $V_t$ is a fixed quantity for any individual MOSFET, and equation (1) does not enable use of a range of values of both x and y.

In order to use the circuit 10 for determining the Euclidean distance in accordance with the invention, it is necessary to provide for a range of values of both x and y to be accommodated. To achieve this, the circuit 10 is first programmed with the voltages $V_{match}$, $V_{ref}$ and ($V_{DD}-V_{ref}$) by UV illumination as described earlier. A voltage $V_{data}$, representing the position of a data point, is then input on line 22 to control gate G1, and its complement ($V_{DD}-V_{data}$) is input on line 24 to control gate G2.

At this point the potential $V_{fg}$ on the floating gate F1 is given by:

$$V_{fg} = \frac{C_{pp}}{C_{tot}}(V_{data} - V_{ref}) + V_{match} \tag{4}$$

where $V_{data}$, $V_{ref}$ and $V_{match}$ are as previously defined, $C_{pp}$ is the capacitance between the floating gate F1 and the control gate G1 and $C_{tot}$ is the total capacitance of the floating gate F1. Equation (4) shows that the floating gate voltage $V_{fg}$ is equal to $V_{match}$ when $V_{data}$ and $V_{ref}$ are equal, which corresponds to the Euclidean distance between locations x and y being zero. It is emphasised that the quantity $V_{ref}$ is a reference voltage used in programming the circuit 10, and it affects the charge stored on the floating gates F1 and F2; however, this quantity is not in fact explicitly stored on either of these gates nor elsewhere in the circuit 10. The equation for the drain-source current treats $V_{ref}$ as a voltage retained by the circuit 10 for subtraction from input voltages.

The drain-source current in the MOSFET M1 is responsive to the signal on the floating gate F1, and the gate-source voltage $V_{gs}$ is equal to $V_{fg}$. Consequently, equation (4) can be substituted in equation (1) for $V_{gs}$:

$$I_{ds} = \frac{\beta}{2}\left(\left(\frac{C_{pp}}{C_{TOT}}(V_{data} - V_{ref}) + V_{match}\right) - V_t\right)^2 \tag{5}$$

Where $V_t$ is the threshold voltage of the MOSFET M1.

By selecting $V_{match}$ to be substantially equal to $V_t$, equation (5) becomes $$I_{ds} = \frac{\beta}{2}\left(\frac{C_{pp}}{C_{TOT}}\right)^2 (V_{data} - V_{ref})^2 \tag{6}$$

If $V_{data}$ and $V_{ref}$ are proportional to points distant x and y respectively from an origin, then from equations (3) and (6) the drain-source current $I_{ds}$ of the MOSFET M1 is proportional to the square of the Euclidean distance d between those points. Similar remarks apply to the MOSFET M2. The circuit 10 is therefore suitable for use in Euclidean distance determination.

Equation (6) is one-dimensional; it applies to Euclidean distance determination when x and y are scalars. When x and y are vectors in n dimensions, one pair of MOSFETs M1 and M2 is required for each dimension as will be described later.

There is substantially no conductor channel in the MOSFET M1 when $V_{data}$ is less than $V_{ref}$, and $I_{ds}$ is zero from equations (6). In consequence the MOSFET M1 provides a measure of Euclidean distance only when $V_{data}$ is greater than $V_{ref}$, which corresponds to x being greater than y in equation (6). A Euclidean distance cannot therefore be determined using a single MOSFET for locations x closer to an origin than the refernece location y. For this reason the circuit 10 has two MOSFETs M1 and M2, the former for values of x greater than y and the latter for values of x less than y. As regards the former, MOSFET M1 is operating in its saturation region; from equation (6), adding a subscript index of 1 to the terms $\beta_M$, $C_{pp}$, $C_{tot}$ and $I_{ds}$ to indicate that they are associated with MOSFET M1:

$$I_{ds1} = \frac{\beta_{M1}}{2}\left(\frac{C_{pp1}}{C_{tot1}}\right)^2 (V_{data} - V_{ref})^2 \tag{7}$$

From equation (7), $I_{ds1}$ provides a measure of the square of the Euclidean distance between x represented by $V_{data}$ and y represented by $V_{ref}$.

When x is less than y, $V_{data}$ is less than $V_{ref}$. From equation (7) there is therefore no conduction channel for MOSFET M1 and drain-source current $I_{ds1}$ is substantially zero. For MOSFET M2, $(V_{DD}-V_{data})$ is the complement of x, and the complement of y is $(V_{DD}-V_{ref})$. $(V_{DD}-V_{data})$ is greater than $(V_{DD}-V_{ref})$ when the value of x, represented by $V_{data}$, is less than that of y. Consequently, from equation (6), adding a subscript index of 2 to the terms $\beta_M$, $C_{pp}$, $C_{tot}$ and $I_{ds}$ to indicate that they are associated with MOSFET M2, the drain-source current $I_{ds2}$ in saturation is given by:

$$I_{ds2} = \frac{\beta_{M2}}{2}\left(\frac{C_{pp2}}{C_{tot2}}\right)^2((V_{DD} - V_{data}) - (V_{DD} - V_{ref}))^2 \tag{8}$$

For x greater than y, $V_{data}$ is greater than $V_{ref}$, $(V_{DD}-V_{ref})$ is more than $(V_{DD}-V_{data})$; the drain-source current $I_{ds2}$ of MOSFET M2 is therefore substantially zero.

Consequently, Euclidean distance squared ($d^2$) is proportional to the drain-source current of MOSFET M1 when x is greater than y, and to that of MOSFET M2 when x is less than y.

Since each of $I_{ds1}$ and $I_{ds2}$ is substantially zero when the other is non-zero, $d^2$ is also proportional to the sum of $I_{ds2}$; this sum is $I_{out}$, the drain-source current of the third MOSFET M3. The common drain node 12 acts as a summing junction which sums the drain-source currents of the MOSFETs M1 and M2 flowing to the third MOSFET M3.

The circuit of FIG. 1 was manufactured by a commercial chip foundry, which produced floating gate MOSFETs with a typical value of $V_t$ of 0.75V. Suitable values of $V_{match}$ are in the range 0.5V to 1.5V, preferably 0.75 V to 1.0 V, and are dependent on the MOSFET technology and threshold voltage used. It was found by experiment that a suitable value of $V_{match}$ for the MOSFETs used in the foregoing example was 0.85V.

Figure 2:
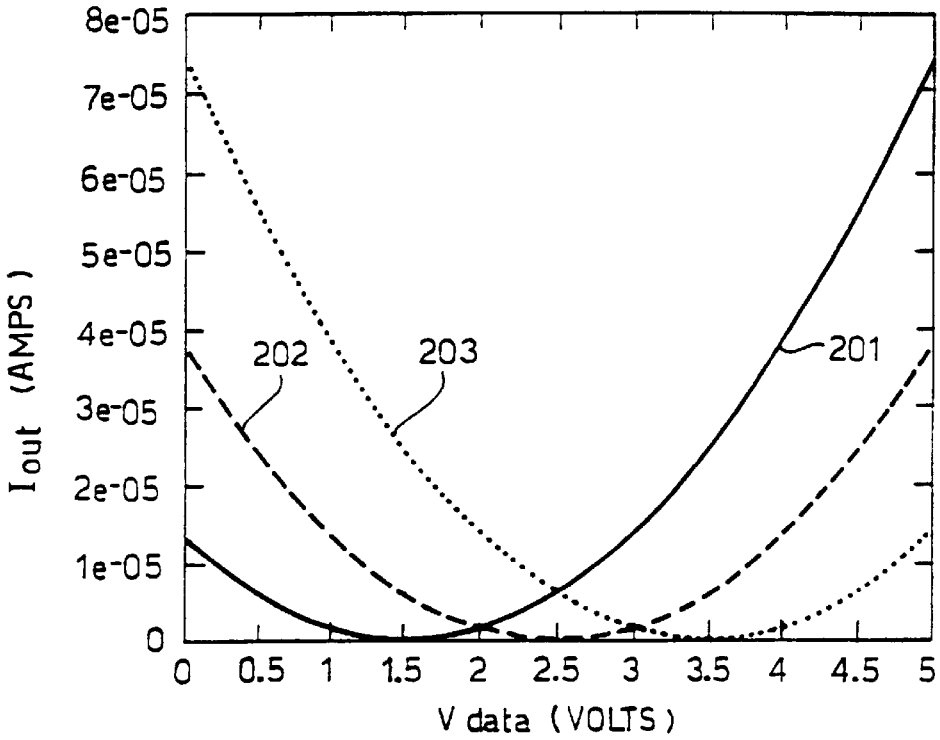
FIG. 2 is a graph of drain-source current against input voltage for the circuit of FIG. 1.

FIG. 2 shows a graph of current at the common drain node 12 against $V_{data}$ for three values of $V_{ref}$. The current at the common drain node 12 is the sum of the drain-source currents $I_{ds1}$ and $I_{ds2}$ of MOSFETs M1 and M2 respectively. FIG. 2 shows three curves 200, 201 and 202 which represent values for $V_{ref}$ of 1.5V, 2.5V and 3.5V. Each of the curves 200 to 202 is parabolic and provides verification that a current $I_{out}$ at node 12 is proportional to the square of the difference between $V_{data}$ and $V_{ref}$.

In this manner the MOSFETs M1 and M2 are employed in the determination of the square of the distance between points x and y, ie. they provide $d^2$ in equation (3). MOSFET M3 is then operated in its saturation region in order to obtain d from the current $I_{out}$ at node 12. A current $I_{LOAD}$ flowing from the common drain node 12 to the drain D3 produces an output voltage $V_{OUT}$ at the gate G3 given by:

$$I_{LOAD} = \frac{\beta_{M3}}{2}(V_{OUT} - V_{T3})^2 \tag{9}$$

In equation (9), $\beta_{M3}$ is a proportionality constant given by equation (2) and $V_{T3}$ is the threshold voltage, for MOSFET M3 in each case.

When the data point x and reference point y are coincident, i.e when the Euclidean distance between them is zero, $I_{LOAD}$ is a small offset current $I_o$:

$$I_o = \frac{\beta_{M3}}{2}(V_o - V_{T3})^2 \tag{10}$$

where $V_o$ is the output voltage resulting from the offset current $I_o$. As the Euclidean distance between points x and y increases, the output voltage $V_{OUT}$ increases by $\delta V_{OUT}$ from $V_o$ to $(V_o+\delta V_{OUT})$, and $I_{LOAD}$ becomes:

$$I_{LOAD} = \frac{\beta_{M3}}{2}((V_o + \delta V_{OUT}) - V_{T3})^2 \tag{11}$$

For values of x greater than that of y, MOSFET M2 has substantially zero drain-source current $I_{ds2}$ and MOSFET M1 supplies non-zero drain current $I_{ds1}$ to MOSFET M3. $I_{LOAD}$ is then given by $$I_{LOAD} = \frac{\beta_{M1}}{2}\left(\frac{C_{pp1}}{C_{tot1}}\right)^2(V_{data} - V_{ref})^2 \tag{12}$$

Combining equations (11) and (12).

$$\frac{\beta_{M3}}{2}((V_o + \delta V_{OUT}) - V_{T3})^2 = \frac{\beta_{M1}}{2}\left(\frac{C_{pp1}}{C_{tot1}}\right)^2(V_{data} - V_{ref})^2 \tag{13}$$

When the Euclidean distance between points x and y is zero, $I_{LOAD}$ is substantially zero and thus from equation (10) $(V_o-V_{T3})$ is substantially zero. Thus from equation (13), $$\frac{\beta_{M3}}{2}(\delta V_{OUT})^2 = \frac{\beta_{M1}}{2}\left(\frac{C_{pp1}}{C_{tot1}}\right)^2(V_{data} - V_{ref})^2 \tag{14}$$

and therefore $$\delta V_{OUT} = \sqrt{\frac{\beta_{M1}}{\beta_{M3}}\left(\frac{C_{pp1}}{C_{tot1}}\right)^2(V_{data} - v_{ref})^2} \tag{15}$$

As $V_{data}$ and $V_{ref}$ represent the data and reference points x and y, then from equation (3) the term in brackets on the right hand side of equation (15) corresponds to the square of the Euclidean distance d between points x and y. Thus $$\delta V_{OUT} \propto d \tag{16}$$

Consequently the Euclidean distance d between data point x and reference point y can be obtained from a measurement of the change in output signal $\delta V_{OUT}$ from the MOSFET M3, and from knowledge of the values of constants $\beta_{M1}$ and $\beta_{M3}$, and $C_{pp1}$ and $C_{tot}$. Alternatively the proportionality constant which relates $\delta V_{OUT}$ to d can be obtained by calibration. It is frequently unnecessary even to calibrate, since for many purposes all that is required is a value proportional to d.

When data point x has a value lower than that of reference point y the drain-source current $I_{ds1}$ of MOSFET M1 substantially zero. From equation (8):

$$I_{LOAD} = \frac{\beta_{M2}}{2}\left(\frac{C_{pp2}}{C_{tot2}}\right)^2((V_{DD} - V_{data}) - (V_{DD} - V_{ref}))^2 \tag{17}$$

and from considerations equivalent to those in equations (13) to (15), $$\delta V_{OUT} = \sqrt{\frac{\beta_{M2}}{\beta_{M3}}\left(\frac{C_{pp2}}{C_{tot2}}\right)^2((V_{DD} - V_{data}) - (V_{DD} - V_{ref}))^2} \quad (18)$$

Thus from equation (18) the Euclidean distance d between points x and y can be obtained from a measurement of the change in output signal $\delta V_{OUT}$ from MOSFET M3, with knowledge of the values of $C_{pp2}$ and $C_{tot2}$ and proportionality constants $\beta_{M2}$ and $\beta_{M3}$.

If MOSFETs M1 and M2 are identical then $\beta_{M1}$ is equal to $\beta_{M2}$, and $C_{pp1}$ and $C_{pp2}$ are equivalent, as are $C_{tot1}$ and $C_{tot2}$. $\delta V_{OUT}$ provides a direct measure of Euclidean distance d without determining which of MOSFETs M1 and M2 is operative. In these circumstances equations (15) and (18) can be written as $$\delta V_{OUT} = \sqrt{\frac{\beta}{\beta_{M3}}\left(\frac{C_{pp}}{C_{tot}}\right)^2 \Delta^2}, \quad (19)$$

where β is the proportionality constant for both MOSFETs M1 and M2, $C_{pp}$ and $C_{tot}$ are capacitance values for both MOSFETs M1 and M2, and Δ is a representation of the voltage difference between points x and y, for values of x both smaller and larger than y.

Figure 3:
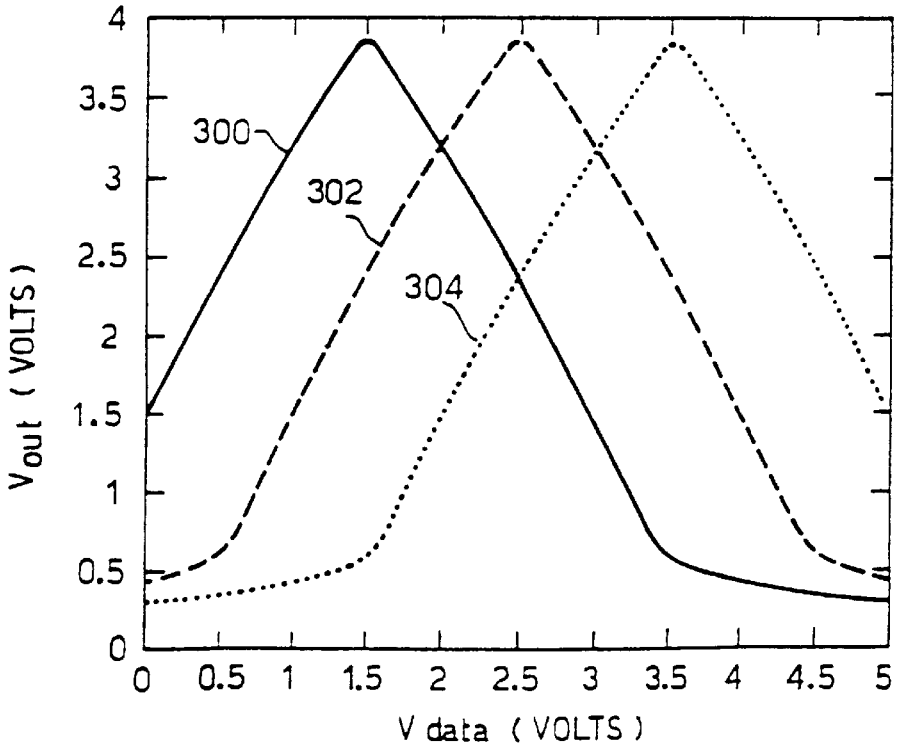
FIG. 3 is a graph of output voltage against input voltage for the circuit of FIG. 1.

FIG. 3 shows a graph of voltage output $V_{OUT}$ at node 12 with respect to ground against $V_{data}$. The graph has curves 300, 302 and 304 corresponding to $V_{ref}$ of 1.5V, 2.5V and 3.5V respectively. The MOSFET M3 is a PMOS enhancement-mode device and is arranged for maximum output voltage when $I_{LOAD}$ is at a minimum. Consequently, curves 300 to 304 have output peaks, rather than minima, when $V_{data}$ is equal to $V_{ref}$. If MOSFET M3 is replaced by an NMOS enhancement mode device and MOSFETs M1 and M2 with PMOS devices, then with power supply polarities inverted equivalent curves would be obtained with minima when $V_{data}$ is equal to $V_{ref}$.

The curves 300 to 304 have regions of lower gradient below output voltages $V_{OUT}$ of 1V. This is because MOSFETs M1 and M2 are no longer operating in saturation. However, the circuit 10 provides a good linear voltage response $V_{OUT}$ to $I_{LOAD}$ over a 3V range of input values $V_{data}$. Slight deviations from linearity are due to small differences between $V_{match}$ and MOSFET M1 and M2 threshold voltages. MOSFET M3 can be designed to provide a substantially linear response over a higher voltage range by increasing its channel width W. This results in a smaller swing in output voltage to give the required linear response over larger range.

The curves 300 to 304 have respective peaks each with linear regions on either side having gradients $$(\beta/\beta_{M3})^{\frac{1}{2}}\left(\frac{C_{pp}}{C_{tot}}\right) \text{ and } -(\beta/\beta_{M3})^{\frac{1}{2}}\left(\frac{C_{pp}}{C_{tot}}\right).$$

A linear region on the right or left of such a peak corresponds respectively to increasing or decreasing Euclidean distance d between points x and y as $V_{data}$ increases.

The electronic circuit 10 has significant advantages over prior art devices for distance calculation. It is more compact than the circuit of Churcher et al and can be operated at lower current levels. The circuit 10 employs the operating characteristics of the MOSFETs M1 and M2 (when programmed with $V_{ref}$) to provide an output current proportional to the square of the Euclidean distance between points x and y. This enables the circuit 10 to accept analogue voltages in respect of x and y.

The compactness, speed and low power requirements of the circuit 10 when that it is advantageous for applications which would otherwise require substantial computing resources, such as pattern recognition.

The circuit 10 may also be operated in its sub-threshold region, i.e. when the channel surface potentials of MOSFETs M1 and M2 are below threshold voltage $V_t$, and in the weak inversion region. For this to occur, $V_{match}$ is much less than the threshold voltage $V_t$. A typical value is 0.4V. More generally, $V_{match}$ is in the range 0.2 V to 0.7 V for sub-threshold operation. Trends in semiconductor technology indicate that threshold voltages will reduce in future, and therefore a suitable range for $V_{match}$ is 0 V to 0.7 V.

In weak inversion the drain-source current $I_{ds}$ of a MOSFET is given by:

$$I_{ds}=I_{offset}\exp(V_{gs}/V_n) \quad (20)$$

where $V_{gs}$ is the gate-source voltage, $I_{offset}$ is an offset current parameter and $V_n$ is the change in gate voltage required to increase current $I_{ds}$ by a factor of e.

For the MOSFET M1, substituting $V_{fg}$ from equation (4) for $V_{gs}$ in equation (20) gives $$\ln(I_{ds1}) = \left(\frac{C_{pp}}{C_{tot}}(V_{data} - V_{ref}) + V_{match}\right)\cdot\frac{1}{V_n} + \ln(I_{offset}) \quad (21)$$

Similarly, for the MOSFET M2, the same analysis results in the equation $$\ln(I_{ds2}) = \left(\frac{C_{pp}}{C_{tot}}(V_{ref} - V_{data}) + V_{match}\right)\cdot\frac{1}{V_n} + \ln(I_{offset}) \quad (22)$$

When the source-drain currents $I_{ds1}$ and $I_{ds2}$ are added at the common drain node 12, both MOSFETs M1 and M2 make a substantial combined contribution only when $V_{data}$ is substantially equal to $V_{ref}$; otherwise, one of the MOSFETs M1 and M2 will provide a dominant current, ie $I_{ds1}$ or $I_{ds2}$ generally dominates. From equations (21) and (22), a current $I_{OUT}$ is produced at the common drain node 12 given by:

$$\ln(I_{OUT}) = \left(\frac{C_{pp}}{C_{tot}}|V_{data} - V_{ref}| + V_{match}\right)\cdot\frac{1}{V_n} + \ln(I_{offset}) \quad (23)$$

Figure 4:
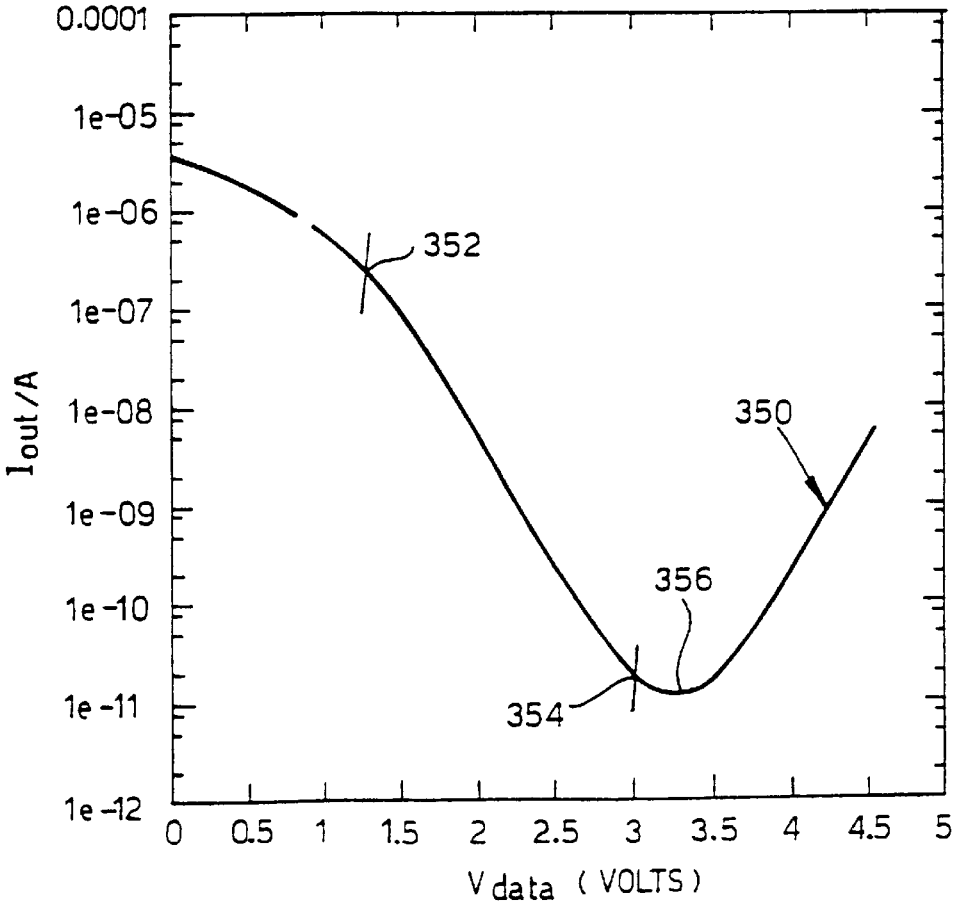
FIG. 4 is a graph of output current against input voltage for sub-threshold operation of the circuit of FIG. 1.

In sub-threshold operation therefore $I_{OUT}$ is an exponential function of the distance between the data and reference points, as shown by the term $|V_{data}-V_{ref}|$ in equation 23. FIG. 4 shows a curve 350 of output current $I_{OUT}$ drawn on a logarithmic scale against $V_{data}$ on a linear scale. The ordinate is graduated with expressions of the kind "le-n", where n is in the range 5 to 12; this expression means $10^{-n}$. The curve 350 is quasi-linear between points 352 and 354 at voltages of 1.25 V and 3 V, a range of 1.75 V comfortably in excess of 1 V or even 1.5 V. Between points 352 and 354 therefore, the logarithm of $I_{OUT}$ varies close to linearly with $V_{data}$, ie $I_{OUT}$ approximates to an exponential function of $V_{data}$. The curve 350 was determined for $V_{ref}$ of 3.3 V, which corresponds to the position of a minimum at 356 on the curve 350. Changing $V_{ref}$ shifts the position of the minimum 356. The curve 350 demonstrates that the circuit 10 operated sub-threshold is suitable for use with a 3.3 V power supply, as employed in conventional digital logic. The modulus of $(V_{data}-V_{ref})$ would be required to be between 0 V and 3.3 V.

The quasi-linear region 352–354 of the curve 350 extends over four orders of magnitude in current, from $22\times10^{-11}$ Amp to $2\times10^{-7}$ Amp. This can be altered by altering $V_{match}$.

FIG. 4 was obtained using MOSFETs optimised for above-threshold operation. For sub-threshold operation, the ratio ($C_{pp}/C_{tot}$) can be reduced to reduce the capacitative coupling between the MOSFET control gate and floating gate. This has the effect of reducing the average slope of the quasi-linear region 352–354 of the curve 350.

Output current $I_{OUT}$ in sub-threshold operation is very low, about two orders of magnitude below that in saturation. This makes sub-threshold operation particularly suitable for low voltage applications, such as in battery powered equipment. It is also possible to operate the third MOSFET M3 sub-threshold to reduce power supply to operate the third MOSFET M3 sub-threshold to reduce power supply voltage further. The circuit 10 may therefore be optimised for operation with a 1.5 V battery, the permissible range for the modulus of ($V_{data}-V_{ref}$) being 0 to 1.5 V.

Figure 5:
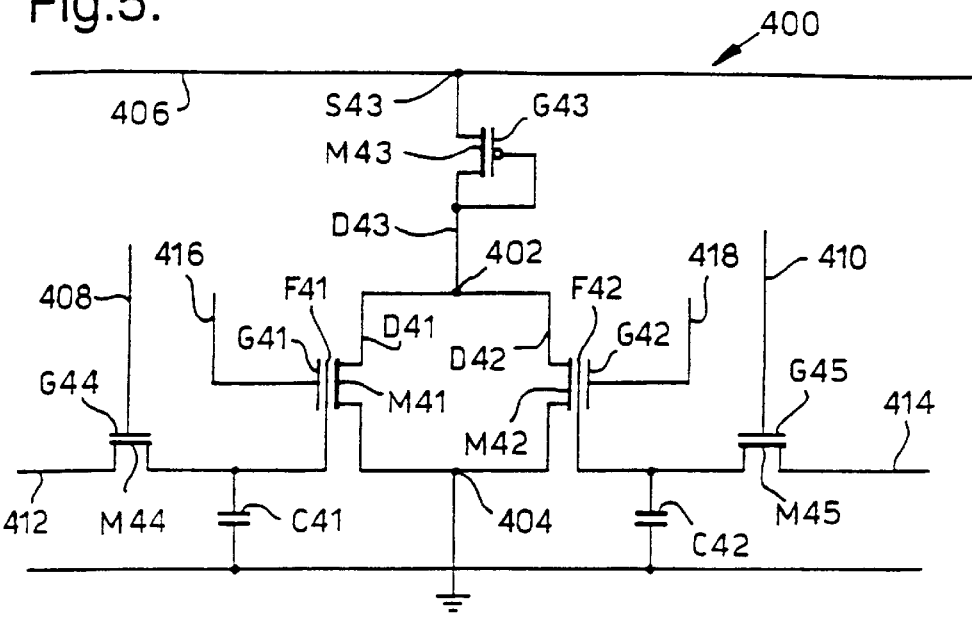
FIG. 5 is a schematic diagram of a circuit of the invention adapted for refreshable programming.

Referring to FIG. 5, there is shown an alternative circuit of the invention indicated generally by 400. The circuit 400 is arranged for electronic resetting the reference point voltage. It incorporates first and second floating-gate MOSFETs M41 and M42 equivalent to those described earlier with reference to FIG. 1. The MOSFETs M41 and M42 have respective floating and control gates F41/G41 and F42/G42. They have the same function as MOSFETs M1 and M2. They are parallel transistors for determining the distance between a reference voltage programmed with the aid of floating gates F41 and F42 and an input voltage and its complement input to control gates G41 and G42.

The MOSFETs M41 and M42 have respective drains D41 and D42 connected to a common drain node 402 and respective sources S41 and S42 connected to an earthed common source node 404.

A third MOSFET M43 has a drain D43 connected to the common drain mode 402. It is equivalent in function to the third MOSFET M3 of the circuit 10, and provides a diode connected load for both MOSFETs M41 and M42. It has a source S43 connected to a power supply line 406 at a positive potential $V_{DD}$.

The circuit 400 incorporates refresh MOSFETs M44 and M45, these being NMOS pass transistors arranged as switches connected to floating gates F41 and F42 of respective MOSFETs M41 and M42.

The MOSFETs M44 and M45 have respective control gates G44 and G45 connected to refresh lines 408 and 410, which provide these gates with an activating voltage, $V_{refresh}$. The MOSFETs M44 and M45 are also connected to respective voltage lines 412 and 414, which provide a substantially constant voltage $V_{match}$.

MOSFETs M41 and M42 have respective data input lines 416 and 418 connected to respective control gates G41 and G42. Data input line 416 is arranged to provide a voltage V in the range 0 to $V_{DD}$ to control gate G41, and data input line 418 is arranged to provide a complement voltage ($V_{dd}-V$) to control gate G42.

The operation of the circuit 400 will now be described. As described earlier in relation to FIG. 1, the MOSFETs M41 and M42 provide a current at the common drain node 402 which is a function of the distance between a data point and a reference point. Referring now also to FIG. 2, there are shown graphs of output current at the common drain node 402 against input $V_{data}$. These graphs illustrate the quadratic relationship between input voltage and current. The third MOSFET M43 produces output voltage and current characteristics which are as shown in FIGS. 3 and 4. The circuits 10 and 400 differ in that the latter has MOSFETs M44 and M45 for periodic resetting of charge corresponding to a reference point stored on floating gates F41 and F42.

To store a reference point on the floating gates F41 and F42, a voltage $V_{match}$ is applied to the voltage lines 412 and 414. The voltage $V_{refresh}$ is then applied to refresh lines 408 and 410 and appears on control gates G44 and G45. $V_{refresh}$ is a higher voltage than the threshold voltages of MOSFETs M44 and M45, which in consequence have conduction channels formed in them to switch them on. Since they are pass transistors, they become effectively short circuits causing floating gates F41 and F42 to become at voltage $V_{match}$.

Voltage $V_{ref}$ representing reference point y is now applied to input line 416 and appears on gate G41. Similarly, its complement ($V_{DD}-V_{ref}$) is applied to input line 418 and appears on gate G42. Voltage $V_{refresh}$ is removed from refresh lines 408 and 410, bringing MOSFETs M44 and M45 below their threshold voltages and switching them off. Consequently, floating gates F41 and F42 are isolated, causing voltage $V_{match}$ to be stored on capacitors C41 and C42. Capacitors C41 and C42 include several contributions, eg junction capacitances to ground of MOSFETs M44 and M45, together with capacitances of floating gates F41 and F42 to control gates G41 and G42 and to conduction channels of MOSFETs M41 and M42. Voltage $V_{data}$ corresponding to data point x is then applied to input line 416, and its complement voltage ($V_{DD}-V_{data}$) is applied to input line 418. These voltages appear on gates G41 and G42 respectively.

When data point x and reference point y are coincident and the Euclidean distance d between them is zero, floating gates F41 and F42 are both at the voltage $V_{match}$. This defines the level of current at match. For x and y non-coincident, a capacitive divider effect couples the voltage $V_{data}$ and ($V_{DD}-V_{data}$) on the control gates G41 and G42 to the floating gates F41 and F42 respectively. This changes the floating gate voltages and the MOSFETs' drain-source currents. The circuit now programmed for operation to determine Euclidean distances.

The circuit 400 is larger than the circuit 10 because it has extra MOSFETs M44 and M45 for refresh purposes. However, it has the advantage that it can be programmed with voltage $V_{ref}$ with greater accuracy and repeatability.

UV illumination is useful for applications in which the positions of reference points rarely change, and for initialisation to remove unwanted charge. The circuit 400 is suitable for applications in which the positions of reference points are required to be changed electronically.

Typical applications for arrays of circuits such as 10 and 400 are radial basis function networks, density estimation circuits and vector quantisation circuits. The invention is relevant to these applications because of its capability for rapid determination of distance together with its relatively small size and low power consumption.

The circuits 10 and 400 are employed individually to determine the distance between two scalar quantities. When it is required to determine the distance between two multi-dimensional quantities, ie two vectors, one of these circuits may be employed repeatedly using successive elements from each of the vectors. Output currents corresponding to pairs of vector elements are summed prior to square rooting. However, this would require circuit reprogramming with a further element of a reference vector after each determination. It is therefore preferable to employ an array of circuits each of the form of the circuit 10 or 400, with each circuit in the array being associated with a respective stored reference vector element. Elements of a data vector are then presented to respective circuits in the array, and subtraction from respective reference vector elements is carried out. The squared differences (see equation (3)) between vector element pairs produced by the circuits are summed by summing their output currents.

To express this in algebraic terms, it is required to determine the Euclidean distance between two n-dimensional vectors, a data vector X with elements $x_i$ and a reference vector Y with elements $y_i$, where i has values 1 to n and indicates the $i^{th}$ dimension. An array of n circuits is employed as aforesaid, with one circuit per dimension. The $i^{th}$ circuit is programmed with $V_{i.ref}$ representing the $i^{th}$ element of the reference vector, and receives input (as $V_{data}$ and its complement) of the $i^{th}$ element of the data vector. The output currents of all n circuits are summed to produce a total current $I_{tot}$ given by:

$$I_{tot} = \sum_{i=1}^{n} (x_i - y_i)^2 \tag{24}$$

By applying the summed current $I_{tot}$ to a single load MOSFET connected as the MOSFET M3 or M43, the Euclidean distance between the multidimensional data and reference vectors is represented by $\delta V_{OUT}$ given by:

$$\delta V_{OUT} \propto \sqrt{\sum_{i=1}^{n} (x_i - y_i)^2} \tag{25}$$

This may be implemented using a one-dimensional array of circuits such as 10 or 400; such an array would require modification to implement current summing. One approach to so doing involves removal of the MOSFETs M3 or M43 and their replacement by a single common MOSFET of sufficient capacity to sum the array's entire current output. Alternatively, all MOSFETs equivalent to M3 or M43 may be retained and connected in parallel, with all current summing nodes being connected directly together. A two-dimensional array of such circuits may be used for simultaneous Euclidean distance determinations involving several data vectors and/or reference vectors, with each row of the array being used for a respective pair of data and reference vectors.

The foregoing programming schemes for the circuits 10 and 400 involve the use of a voltage $V_{match}$ in setting MOSFET floating gate potentials. Since a floating gate is isolated, it is difficult to determine the degree of accuracy to which a desired floating gate potential might be reached. Furthermore, supposedly identically produced MOSFETs such as M1 and M2 exhibit inter-device variations leading to differing threshold voltages. An additional consideration is that the efficiency of charge injection on to a floating gate changes with use, so that programming characteristics alter. It has been discovered that it is possible to compensate for all these variations by programming a MOSFET until it has a desired drain-source current, with the aid of additional circuitry described below.

Figure 6:
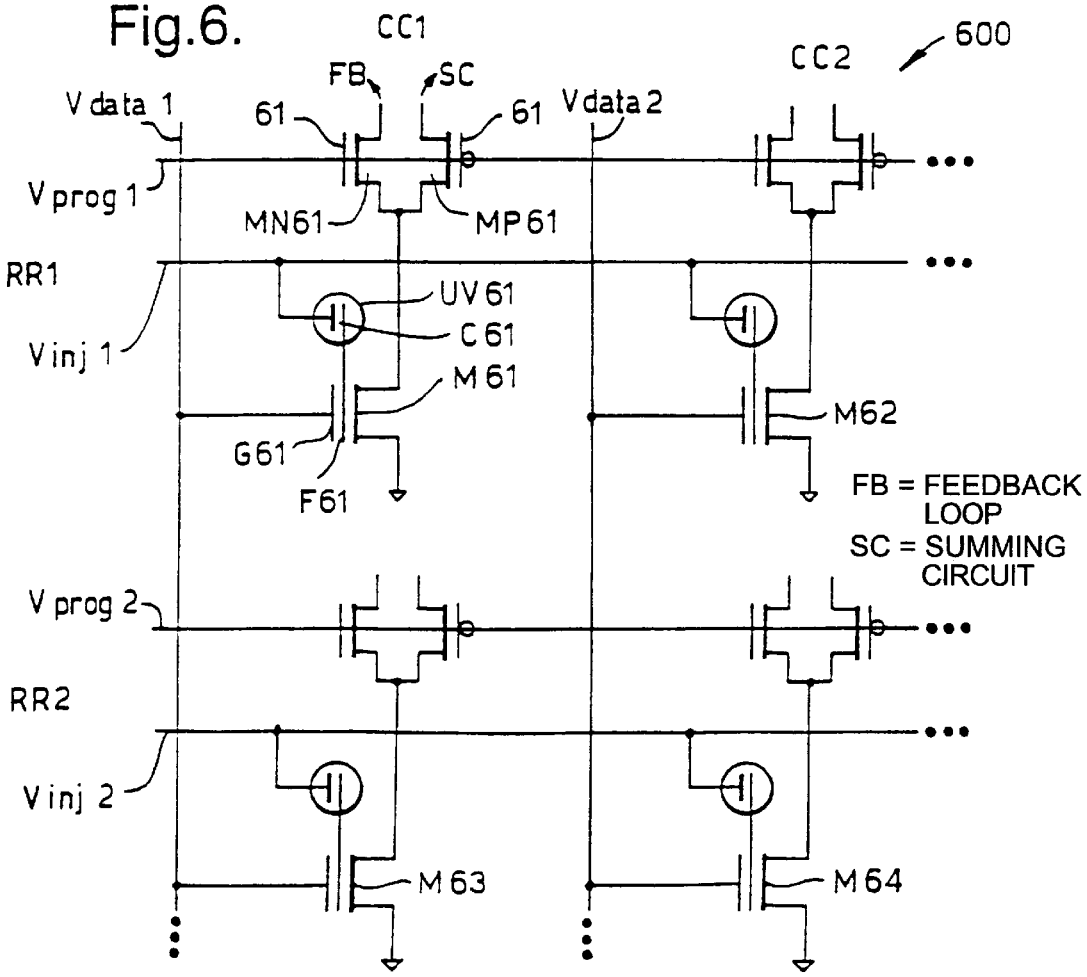
FIG. 6 is a schematic diagram of an array of circuits illustrating use of feedback in programming.

Referring to FIG. 6, there is shown an array 600 of four floating-gate MOSFETs M61, M62, M63 and M64 arranged in two rows RR1 and RR2 and two columns CC1 and CC2. The first floating-gate MOSFET M61 has a control gate G61 and a floating gate F61 connected to a UV-activatable coupling capacitor C61 under a UV-transparent window UV61. Other floating-gate MOSFETs M62 etc have like parts (unreferenced). The coupling capacitance ratio ($C_{pp}/C_{tot}$) of all control gates such as G61 is approximately 0.5. The capacitance of all coupling capacitors C61 etc is much smaller than this.

The first floating-gate MOSFET M61 is connected drain-to-source to two switching MOSFETs, n-channel and p-channel devices MN61 and MP61 with switching gates GN61 and GP61 respectively. As indicated at FB and SC, the MOSFETs MN61 and MP61 have drains connected to a feedback loop (not shown) and a summing circuit (not shown) respectively. The feedback loop FB incorporates a current comparator. The columns CC1 and CC2 have respective data lines Vdata1 and Vdata2 each connected to all control gates in the respective column, such as control gate G61 in the first column CC1.

The rows RR1 and RR2 have respective injector lines Vinj1 and Vinj2 each connected to all coupling capacitors in the respective row, such as coupling capacitor C61 in the first row RR1. The rows RR1 and RR2 also have respective programming lines Vprog1 and Vprog2 each connected to all switching gates in the respective row, such as switching gates GN61 and GP61 in the first row RR1.

The array 600 comprises four floating-gate and switching MOSFET circuits each incorporating one floating-gate MOSFET such as M61 and two switching MOSFETs such as MN61 and MP61. Each such circuit is connected in parallel with a second like circuit (not shown) as will be described later. The two p-channel switching MOSFETs of each row (eg MOSFET MP61 in first row RR1) are connected to a respective current summing circuit such as SC.

The array 600 is programmed as follows. One row RR1 or RR2 is programmed at a time, with all the floating-gate MOSFETs in that row being programmed in parallel. When the programming line Vprog1 is at a high voltage, the n-channel switching MOSFET MN61 is switched ON and the p-channel switching MOSFET MP61 is switched OFF. Current then flows through the n-channel device and into the feedback loop FB. One feedback loop FB serves all the circuits of each column. When the programming line Vprog1 is at a low voltage, the n-channel and p-channel switching MOSFETs MN61 and MP61 are switched OFF and ON respectively. The current is then directed onto the current summing circuit SC for operation of the circuit after programming. To program the first row RR1 with the elements of a reference vector, voltages representing those elements are applied to lines Vdata1 and Vdata2. The first programming line Vprog1 is held at high voltage to switch the drain-source currents of the floating-gate MOSFETs M61 and M62 into their respective feedback loops such as FB. A high voltage is then applied to the first injector line Vinj1, and the second injector line Vinj2 is grounded. This injector line high voltage is in the range 15 V to 17 V, and is optionally continuous or a train of pulses. It produces charge tunnelling at both first row floating gates such as F61 as electrons are removed therefrom.

Electron removal changes the floating gate potential and the drain-source current of each of the first row floating-gas MOSFETs M61 and M62. The comparator in the feedback loop of each of these MOSFETs is designed to change state and to switch the associated Vdata1 or Vdata2 line to a high voltage of 15 V when the MOSFET M61 or M62 reaches the desired drain-source current. If for example the first row, first column MOSFET M61 reaches the desired drain-source current first, then Vdata1 becomes switched to 15 V. Moreover, because ($C_{pp}/C_{tot}$) is 0.5, by capacitive divider effect the floating gate potentials of the MOSFETs M61 and M63 connected to Vdata1 change by up to half of the Vdata1 voltage, is by up to 7.5 V. By virtue of the 15 V potential on line Vinj1 and that now on the first MOSFET floating gate F61, an electric field arises across the coupling capacitor C61. However, this field is not sufficiently high to cause significant charge tunnelling involving the floating gate F61, and programming of the first MOSFET M61 ceases. A similar field of opposite polarity arises between the ground line Vinj2 and the floating gate of the third MOSFET M63, but this is also insufficient to cause tunnelling and it does not affect the third MOSFET's programming. However, the injector line Vinj1 remains at high voltage, and programming continues for the remaining second (and final) MOSFET M62 in the first row RR1. When the comparator in the feedback loop of this MOSFET has changed state, the first row RR1 is fully programmed.

Programming of the second row RR2 is carried out in a like manner. As before, voltages representing the elements of a reference vector are applied to lines Vdata1 and Vdata2. A high voltage is applied to the second programming line Vprog2 and to the second injector line Vinj2, and the first injector line Vinj1 is grounded. This situation is maintained until both the comparators in the feedback loops of the second row MOSFETs M63 and M64 have changed state, at which point the second row RR2 and the entire array 600 are fully programmed.

The array 600 is now ready for input of the elements of a data vector to respective data lines Vdata1 and Vdata2. Arrays with more than two rows and/or columns are programmed likewise row by row, all the feedback comparators in each row changing state before programming of the subsequent row begins.

The foregoing programming scheme may be unidirectional; it might not be capable of both increasing and reducing the charge on a floating gate such as F61. This is because the process employed to produce the MOSFET may not be able to tolerate both positive and negative high voltages in programming.

In the present example it was only possible to remove charge from a floating gate such as F61. Charge removal raises the potential of a floating gate, lowers the effective MOSFET threshold voltage and hence increases the MOSFET drain-source current. In consequence the desired current to be programmed is approached from below. However, MOSFET floating gates have an arbitrary charge placed on them during manufacture, and it is therefore necessary to ensure that each of them has an initial potential which is below that required to use. This is also necessary if the array 600 is ever to be reprogrammed. It is achieved by UV illumination through the windows such as UV61. An alternative initialisation approach would involve relocated UV windows enabling UV illumination of control gates such as G61. This provides for ageing during initialisation to be confined to the gate region, leaving the capacitors (eg C61) unaffected.

The array programming technique described above has been verified in a test using two floating gate MOSFETs configured as the first row RR1 of the array 600 except that switching transistors MN61 etc were not employed. Instead external switches were used. The initial drain-source current to be programmed was chosen to be 164 nA. The test MOSFETs were programmed using a train of high-voltage pulses, the drain-source current in each being checked after each pulse.

Figure 7:
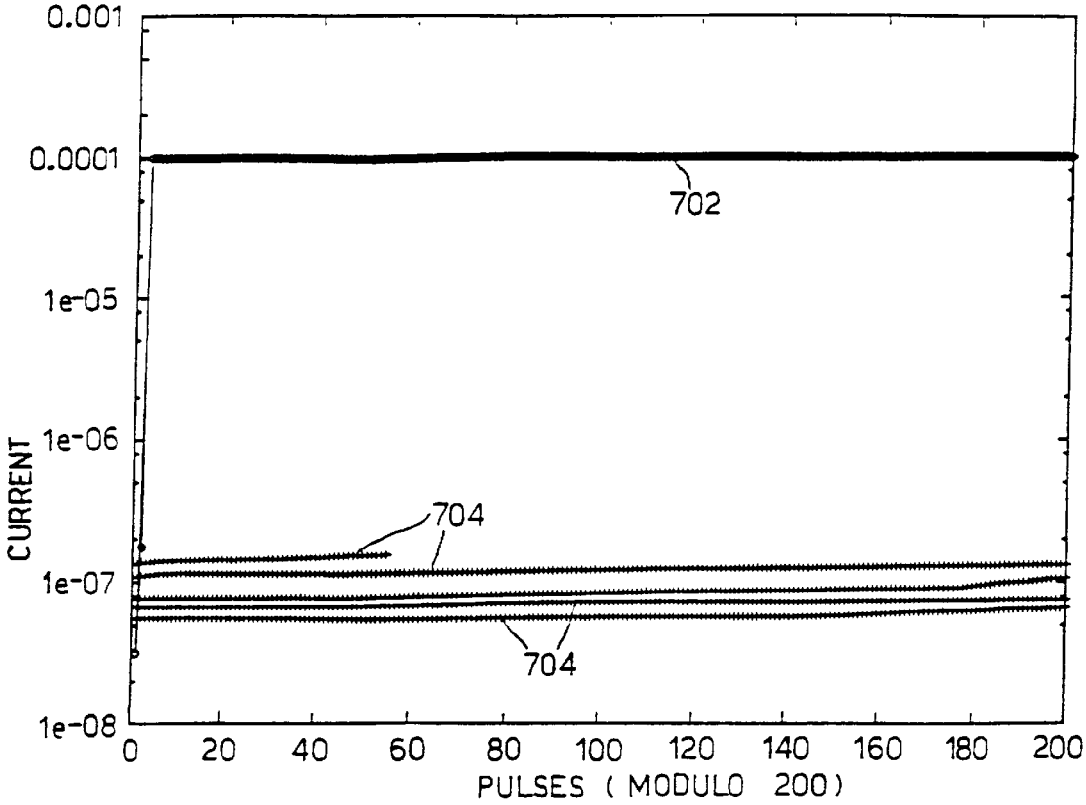
FIGS. 7, 8 and 9 are graphs illustrating progress in programming the circuit of FIG. 6.

Referring now to FIG. 7, there is shown the response of the two test MOSFETs to programming with high-voltage pulses. There were very significant differences between the capacitors of these two devices, which made them difficult to program by any method which assumed them to be equivalent. The input reference voltages Vdata1 and Vdata2 were set to 0.8 V and 0.9 V respectively, and the train of high-voltage pulses was applied as Vinj1 to both coupling capacitors. The first test MOSFET reached the desired drain-source current of 164 nA after just two pulses, as indicated by the uppermost horizontal line 702 and thereafter its gate voltage was pulled to a high voltage as described earlier. The second test MOSFET had a severely damaged injector which took much longer to program; it required eight hundred and fifty-five pulses before it reached the desired drain-source current. This is indicated by the succession of four lines and part line 704 in the lower region of FIG. 7, where the number of pulses is expressed on a modulo 200 basis. The abscissa value therefore returns to zero after each set of two hundred pulses and each complete line 704 represents such a set.

Figure 8:
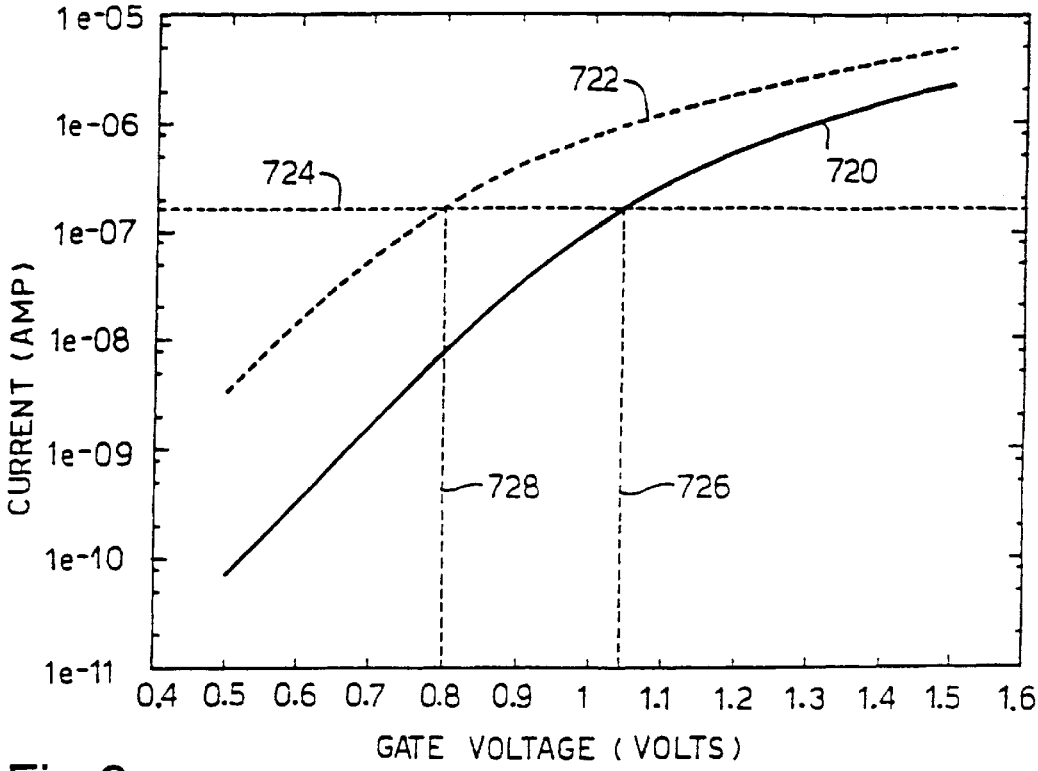
Figure 9:
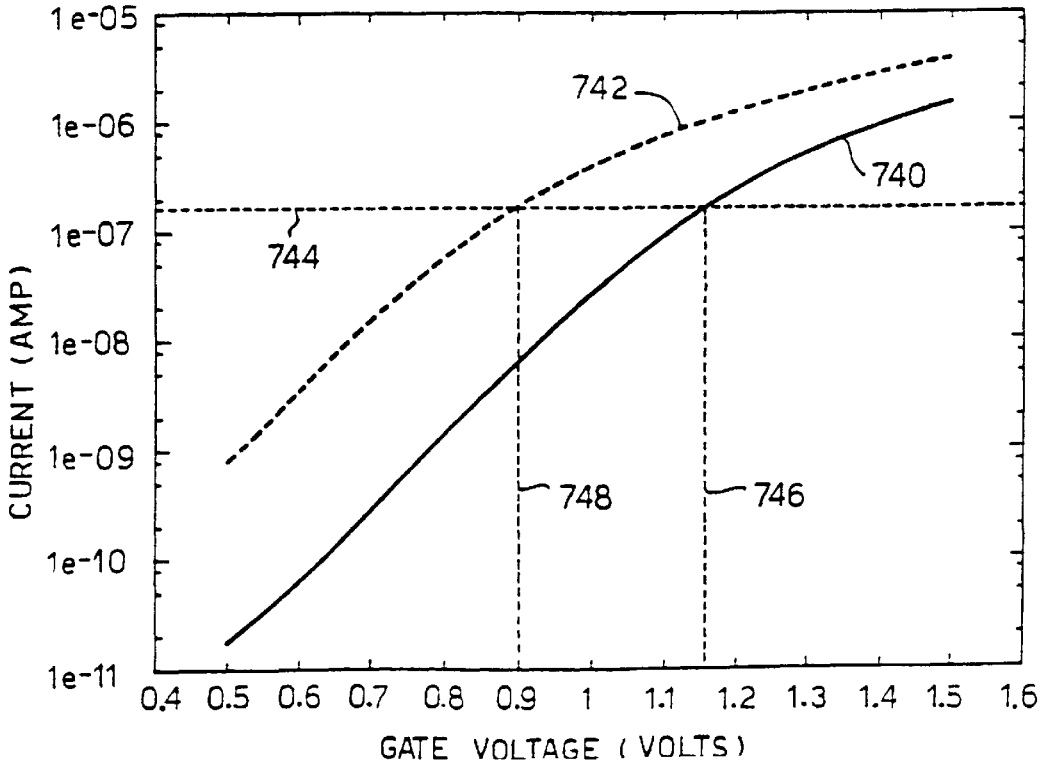

Referring now to FIGS. 8 and 9, there are shown drain-source current/voltage curves for the first and second test MOSFETs respectively. Current is plotted on a logarithmic scale and voltage on a linear scale. In these drawings, solid curves 720/740 and dotted curves 722/742 relate to MOSFETs before and after programming respectively; horizontal dotted lines 724/744 indicate the desired drain-source current of 164 nA, and vertical dotted lines 726/728 and 746/748 indicate the MOSFET gate voltages at which the desired current was reached before/after programming. Line 726 in FIG. 8 shows that, before programming, the first test MOSFET exhibited the desired current at a gate voltage of 1.044 V. From FIG. 9, line 746, the equivalent for the second test MOSFET was 1.159 V. These values correspond to unprogrammed stored data points.

Curves 722 and 742 show that, after programming, the stored data points of the test MOSFETs were 0.799 V and 0.900 V, very close and identical respectively to the desired values previously input as reference voltages Vdata1 and Vdata2. In programming the first test MOSFET there was a minor overshoot of 1 mV, which could have been avoided by using lower voltage programming pulse.

Figure 10:
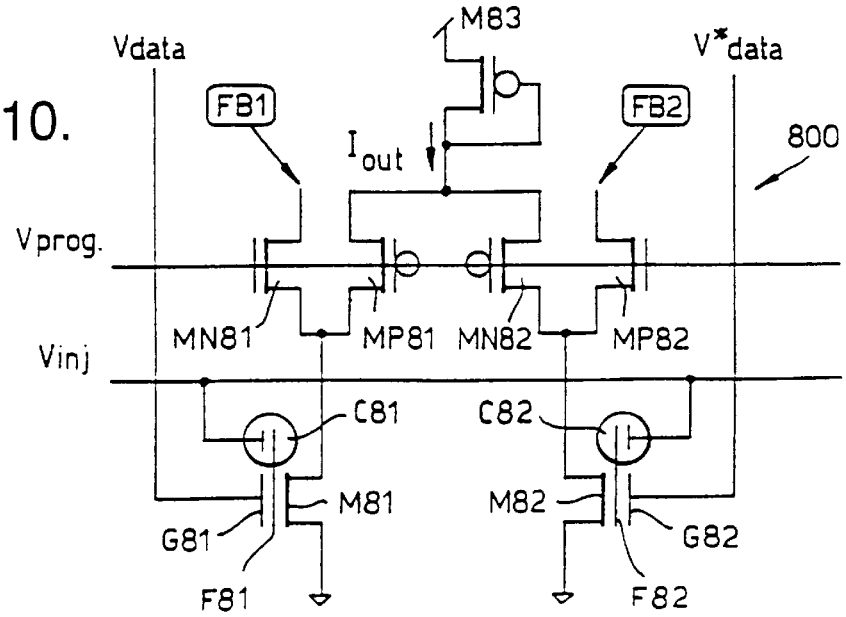
FIG. 10 is a schematic diagram of a further embodiment of the invention designed to employ feedback in programming.

Referring now to FIG. 10, there is shown a single Euclidean distance circuit indicated generally by 800. It is suitable for replication to produce an array as previously described with reference to FIG. 6. It incorporates two floating gate MOSFET M81 and M82 each connected drain-to-source to a respective pair of n-channel and p-channel switching MOSFETs MN81/MP81 and MN82/MP82. The n-channel switching MOSFETs MN81 and MN82 are connected to respective feedback circuits indicated by FB1 and FB2. The p-channel switching MOSFETs MP81 and MP82 are connected to a p-channel diode-connected load MOSFET M83. The floating-gate MOSFETs M81/M82 have respective control gates G81/G82, floating gates F81/F82 and coupling capacitors C81/C82. The control gates G81 and G82 are respectively connected to input lines Vdata and V*data, which are for input of voltages and their complements respectively. The coupling capacitors C81 and C82 are connected to a charge injection line Vinj. The switching MOSFETs MN81/MP81 and MN82/MP82 are connected to a programming line Vprog.

The circuit 800 is programmed as described earlier for the circuit 600, except that the input line V*data receives the complement (as defined earlier) of the voltage applied to the input line Vdata, and these voltages are applied simultaneously. When programming is complete, the n-channel switching MOSFETs MN81 and MN82 turn OFF and the p-channel switching MOSFETs MP81 and MP82 turn ON. This switches both the floating gate MOSFETs M81 and M82 from connection to respective feedback circuits FB1 and FB2 to connection jointly to the load MOSFET M83, and the circuit 800 is ready for use to receive an input data value x as described earlier with reference to FIG. 1.

In an array of circuits 800, there is one pair of input lines Vdata and V*data for each column, and for each row an injection line Vinj and a programming line Vprog. The arrangement of these lines is similar to that shown in FIG. 6 with provision for the additional MOSFETs MN82 etc and associated circuitry.

We claim:

1. An electronic circuit for providing an analog output that is proportional to one of a substantially quadratic function and a substantially exponential function of the difference between an input voltage and a reference voltage with which the circuit has been programmed, said circuit comprising:

(a) a first transistor having a channel conductivity, said first transistor having: a current input; an output; a control input; and a programmable threshold, said first transistor threshold programmed by a stored charge defining a transistor current operating regime when a voltage on said first transistor control input exceeds said reference voltage;

(b) a second transistor having a like channel conductivity, said second transistor having: a current input; an output; a control input; and a programmable threshold, said second transistor threshold programmed by a stored charge defining a transistor current operating regime when a voltage on said second transistor control input exceeds a complementary voltage to said reference voltage, said regime for said first and second transistors is one of a relatively high transistor current operating regime and a relatively low transistor current operating regime corresponding to said substantially quadratic function and a substantially exponential function, respectively;

(c) said input voltage being supplied to said control input of said first transistor and the complement of said input voltage being supplied to the control input of said second transistor; and (d) said outputs of said two transistors connected together to provide said analog output.

2. An electronic circuit (10) according to claim 1, further including means for applying programming voltages ($V_{match}$) to the transistor pair (M1, M2) such that the supply of the reference voltage ($V_{ref}$), in conjunction with the supply of the programming voltages ($V_{match}$), and the subsequent supply of the input data voltage ($V_{data}$) causes a signal at the analog output (12) which is an exponential function of the difference between the reference ($V_{ref}$) and data ($V_{data}$) voltages.

3. An electronic circuit (10) according to claim 2 wherein the transistor pair (M1, M2) are arranged for sub-threshold operation and the programming voltages ($V_{match}$) are in the range 0.2 V to 0.7 V.

4. An electronic circuit (10) according to claim 2 wherein the transistor pair (M1, M2) are arranged for sub-threshold operation and the programming voltages ($V_{match}$) are in the range 0 V to 0.7 V.

5. An electronic circuit (10) according to claim 4 wherein the input voltages ($V_{ref}$, $V_{dd}-V_{ref}$; $V_{data}$, $V_{DD}-V_{data}$; $V_{match}$) are in the range of 0 V to 3.3 V and the circuit (10) is capable of operation with a conventional digital logic power supply of 3.3 V.

6. An electronic circuit (10) according to claim 5 wherein the input voltages ($V_{ref}$, $V_{DD}-V_{ref}$; $V_{data}$, $V_{DD}-V_{data}$; $V_{match}$) are in the range 0 V to 1.5 V and the circuit (10) is capable of operation with a 1.5 V power supply.

7. An electronic circuit (10) according to claim 4 wherein said circuit is incorporated into an array of like electronic circuits each having a respective transistor pair (M1, M2), at least some of the transistor pairs having outputs connected to a common summing means and thereafter to a diode-connected load transistor (M3) arranged for sub-threshold operation such that the load transistor output voltage is substantially proportional to the natural logarithm of the sum of the output currents from the selected transistor pairs.

8. An electronic circuit (10) according to claim 1 wherein the circuit also includes a diode-connected load transistor (M3) having a drain (D3) connected to the analog output (12) and arranged to produce an output voltage which is a function of the difference between the reference voltage ($V_{ref}$) and the input data voltage ($V_{data}$).

9. An electronic circuit (10) according to claim 8 wherein the input voltages ($V_{ref}$, $V_{DD}-V_{ref}$; $V_{data}$, $_{VDD}-V_{data}$; $V_{match}$) are in the range 0 V to 1.5 V and the diode-connected load transistor (M3) is arranged for sub-threshold operation and the circuit (10) is operable with a 1.5 V power supply.

10. An electronic circuit (10) according to claim 1 wherein the programming means (18, 20) includes means for applying programming voltages ($V_{match}$) of sufficient magnitude to operate the transistor pair (M1, M2) in their saturation regions and to provide for them to exhibit an output current proportional to a quadratic function of the difference between a reference voltage ($V_{ref}$) and an input data voltage ($V_{data}$).

11. An electronic circuit (10) according to claim 10 wherein the circuit also includes means (22, 24) for applying respective input voltages to the transistor pair (M1, M2) simultaneously, one input voltage ($V_{DD}-V_{ref}$, $V_{DD}-V_{data}$) being the complement of the other ($V_{ref}$, $V_{data}$).

12. An electronic circuit (10) according to claim 10 wherein the circuit also includes means for summing the output currents of the transistor pair (M1, M2).

13. An electronic circuit (10) according to claim 10 wherein the circuit also includes means (M3) for deriving square roots connected to the analog output (12).

14. An electronic circuit (10) according to claim 13 wherein the means for deriving square roots is a diode-connected load transistor (M3) having a drain connected to the analog output (12) and arranged to produce an output voltage substantially proportional to the difference between the reference and data voltages ($V_{ref}$, $V_{data}$).

15. An electronic circuit (10) according to claim 10 incorporated into an array of like electronic circuits each having a respective transistor pair (M1, M2), at least some of the transistor pairs having outputs connected to a common summing means and thereafter to a diode-connected load transistor (M3) such that the load transistor output voltage is substantially proportional to the square root of the sum of the output currents from the selected transistor pairs.

16. An electronic circuit (10) according to claim 1 wherein the programmable transistor pair (M1, M2) are metal oxide field effect transistors each of the kind incorporating a control gate (G1, G2) and a floating gate (F1, F2) and further including programming means for storing charge on the floating gates (F1, F2).

17. An electronic circuit (10, 400) according to claim 1 further including resetting means (UV1, C1, UV2, C2, M44, M45) for periodically resetting the programmable transistor pair (M1, M2) for the purposes of reprogramming with a different value of reference voltage ($V_{ref}$, $V_{DD}-V_{ref}$).

18. An electronic circuit (10) according to claim 17 wherein each transistor of the transistor pair (M1, M2) incorporates a respective control gate (G1, G2) and a respective floating gate (F1, F2), and the resetting means includes respective conducting means (C1, C2) connected to the floating gates (F1, F2) and activatable to conduct when exposed to ultra-violet light, ultra-violet window means (UV1, UV2) arranged over the conducting means (C1, C2), and means for illuminating the conducting means (C1, C2) with ultra-violet radiation.

19. An electronic circuit (400) according to claim 17 wherein each transistor of the transistor pair (M1, M2) incorporates a respective control gate (G1, G2) and a respective floating gate (F1, F2), and the resetting means includes first and second reset transistors (M44, M45) arranged to supply programming voltages ($V_{match}$) to the floating gates (F1, F2).

20. An electronic circuit (400) according to claim 19 wherein the reset transistors (M44, M45) are controllable by a reset voltage ($V_{refresh}$) to provide for:

(i) application of programming voltages ($V_{match}$) to the floating gates (F1, F2), and (ii) isolation of the floating gates (F1, F2).

21. An electronic circuit (10, 400) according to claim 1 further including programming means (18, 20) arranged to supply substantially equal programming voltage ($V_{match}$) to the transistors (M1, M2) of the transistor pair.

22. An electronic circuit (10, 400) according to claim 21 wherein programming voltages ($V_{match}$) are in the range 0.5 V to 1.5 V.

23. An electronic circuit (10, 400) according to claim 22 wherein the programming voltages ($V_{match}$) are in the range 0.75 V to 1.0 V.

24. An electronic circuit (10, 400) according to claim 23 wherein the programming voltages ($V_{match}$) are substantially 0.85 V.

25. An electronic circuit according to claim 1 wherein each transistor (M81) of the transistor pair (M81, M82) has a current output connected to a respective switching means (MN81, MP81), the switching means is connected to threshold programming means (FB1, $V_{inj}$) and to current summing means (SC), and the switching means (MN81, MP81) is operative to switch the respective transistor output current from the threshold programming means (FB1, $V_{inj}$) to the current summing means (SC) in response to a predetermined circuit condition.

26. An electronic circuit (800) according to claim 25 wherein each transistor of the transistor pair (M81, M82) incorporates a respective control gate (G81, G82) and a respective floating gate (F81, F82), and the switching means comprises a second transistor pair (MN81, MP81) of differing channel conductivity type and an injecting means ($V_{inj}$) is arranged to apply a programming voltage of sufficient magnitude to establish charge injection onto the floating gates (F81, F82) and thereby to enable variation of transistor (M81, M82) current output.

27. An electronic circuit (800) according to claim 26 wherein the threshold programming means (FB1, $V_{inj}$) is connected to a data input line ($V_{data}$) and arranged to switch a voltage applied to the data input line ($V_{data}$) to a value of sufficient magnitude to prevent charge injection onto the floating gates (F81, F82) in response to attainment of a predetermined current.

28. An electronic circuit according to claim 1 is incorporated in an array (600) of like electronic circuits.

29. An electronic circuit according to claim 28 wherein each transistor (M81) of the transistor pair (M81, M82) has a current output connected to switching means (MN81, MP81), the switching means is connected to threshold programming means (FB1) and to current summing means (SC), the switching means (MN81, MP81) is operative to switch the transistor output current from the threshold programming means (FB1) to the current summing means (SC) in response to attainment of a predetermined circuit condition and the circuit is connected to a pair of data input lines ($V_{data}$, $V^*_{data}$) associated with a column of the array and to a threshold programming line ($V_{inj}$) and a switching activation line ($V_{prog}$) both associated with a row of the array.

30. An electronic circuit according to claim 29 incorporated into a one-dimensional array arranged for Euclidean distance determination or sub-threshold operation involving a multidimensional data vector ($V_{data1}$, $V_{data2}$).

31. An array (600) of electronic circuits each circuit incorporating a circuit according to claim 1.

32. An array (600) of electronic circuits (10, 400, 800) according to claim 31 wherein said transistors (M1, M2) are metal oxide field effect transistors (MOSFETs), each of the kind incorporating a control gate (G1, G2) and a floating gate (F1, F2), and further characterised in that the programming means (FB, $V_{inj}$) is arranged to store charge on each floating gate (F61).

33. An array (600) of electronic circuits according to claim 32 said circuits are connected to form rows (RR1, RR2) and columns (CC1, CC2) of the array, the circuits in each column have inputs connected to a respective pair of data input lines ($V_{data}$, $V^*_{data}$), and each row incorporates a respective programming line ($V_{inj}$) connected to the programming means (C81, C82, F81, F82) of circuits therein and a respective switching activation line ($V_{prog}$) connected to the switching means (MN81, MP81; MN82, MP82) of circuits therein.

34. An array (600) of electronic circuits according to claim 33 further including an injecting means arranged to apply a voltage to the programming line ($V_{inj1}$) of sufficient magnitude to establish charge injection onto the floating gates (F61) of all transistors in a row (RR1) and the threshold programming means (FB, $V_{inj1}$) is arranged to switch the voltage applied to the data input line ($V_{data1}$) to a value of sufficient magnitude to prevent charge injection onto the floating gates of all transistors in a column (CC1) in response to attainment of a predetermined circuit condition and thereby to enable individual programming of transistors.

35. An array (600) according to claim 31 wherein the array (600) is one dimensional and arranged for Euclidean distance determination involving a multidimensional data vector ($V_{data1}$, $V_{data2}$).

36. An electronic circuit according to claim 1, wherein said analog output is proportional to said substantially quadratic function and said regime for said transistors is said relatively high transistor current operating regime.

37. An electronic circuit according to claim 1, wherein said analog output is proportional to said substantially exponential function and said regime for said transistors is said relatively low transistor current operating regime.

38. A method for determining a distance between two points represented by analogue voltages ($V_{ref}$, $V_{data}$), and comprising the steps of:

(a) providing a circuit (10,400,800) incorporating two programmable threshold voltage transistors (M1,M2) associated with a common current output (12), (b) arranging the transistors (M1,M2) to provide for their output current to be a quadratic or exponential function of the difference between a programmed reference voltage ($V_{ref}$) and subsequent transistor input data voltages ($V_{data}$) in complementary form, (c) programming the transistors (M1,M2) with stored reference voltages ($V_{ref}$,$V_{DD}-V_{ref}$), one such reference voltage ($V_{DD}-V_{ref}$) applied to one of said transistors being the complement of the reference voltage ($V_{ref}$) applied to the other of said transistors.

39. A method of reprogramming a circuit (400) arranged for the calculation of a function of the difference between two voltages, the circuit (400) comprising a pair of programmable transistors (M41, M42), each transistor incorporating a respective control gate (G41, G42) and a respective floating gate (F41, F42) the method comprises the steps of:

(a) applying programming voltages ($V_{match}$) to switching means (M44, M45) connected to respective floating gates (F1, F2) of the transistor pair (M41, M42), (b) applying a reset voltage ($V_{refresh}$) to the switching means (M44, M45) whereby the programming voltages ($V_{match}$) are communicated to the floating gates (F1, F2), (c) applying a reference voltage ($V_{ref}$, $V_{DD}-V_{ref}$) in complementary analogue form to the control gates (G1, G2) of the transistor pair (M41, M42), (d) removing the reset voltage ($V_{refresh}$) from the switching means (M44, M45) and thereby electrically isolating the floating gates (F41, F42), and (e) removing the reference voltage ($V_{ref}$, $V_{DD}-V_{ref}$) from the control gates (G41, G42).

40. An electronic circuit for providing an analog output that is proportional to a substantially quadratic function of the difference between an input voltage and a reference voltage with which the circuit has been programmed, said circuit comprising:

(a) a first transistor having a channel conductivity, said first transistor having: a current input; an output; a control input; and a programmable threshold, said first transistor threshold programmed by a stored charge defining a relatively high transistor current operating regime when a voltage on said first transistor control input exceeds said reference voltage;

(b) a second transistor having a like channel conductivity, said second transistor having: a current input; an output; a control input; and a programmable threshold, said second transistor threshold programmed by a stored charge defining a relatively high transistor current operating regime when a voltage on said second transistor control input exceeds a complementary voltage to said reference voltage;

(c) said input voltage being supplied to said control input of said first transistor and the complement of said input voltage being supplied to the control input of said second transistor; and (d) said outputs of said two transistors connected together to provide said analog output.

41. An electronic circuit for providing an analog output that is proportional to a substantially exponential function of the difference between an input voltage and a reference voltage with which the circuit has been programmed, said circuit comprising:

(a) a first transistor having a channel conductivity, said first transistor having: a current input; an output; a control input; and a programmable threshold, said first transistor threshold programmed by a stored charge defining a relatively low transistor current operating regime when a voltage on said first transistor control input exceeds said reference voltage;

(b) a second transistor having a like channel conductivity, said second transistor having: a current input; an output; a control input; and a programmable threshold, said second transistor threshold programmed by a stored charge defining a relatively low transistor current operating regime when a voltage on said second transistor control input exceeds a complementary voltage to said reference voltage;

(c) said input voltage being supplied to said control input of said first transistor and the complement of said input voltage being supplied to the control input of said second transistor; and (d) said outputs of said two transistors connected together to provide said analog output.

* * * * *